US006164452A

United States Patent [19]

Ellis

[11] Patent Number: 6,164,452

[45] Date of Patent: Dec. 26, 2000

[54] PERSONAL OPTICAL CARE CONTAINER

[76] Inventor: Robert Ellis, 240 N. Jones #262, Las Vegas, Nev. 89107

[21] Appl. No.: 09/272,292

[22] Filed: Mar. 19, 1999

[51] Int. Cl.[7] ..... B65D 69/00; A45C 11/04

[52] U.S. Cl. ..... 206/581; 206/5; 206/5.1

[58] Field of Search ..... 206/5, 6, 5.1, 581, 206/37, 38; 16/110.5, 110 R; D3/263, 265, 266; 224/578, 579, 607, 664, 679; 220/754–756, 757, 555, 553, 522, 789–791

[56] References Cited

U.S. PATENT DOCUMENTS

| | | | |
|---|---|---|---|
| D. 223,784 | 6/1972 | Rios . | |
| D. 251,596 | 4/1979 | Priestley, Jr. . | |
| D. 293,624 | 1/1988 | Sherman | D3/265 |
| D. 404,568 | 1/1999 | Newcomer | D3/265 |
| 2,735,597 | 2/1956 | Treleven . | |
| 3,955,728 | 5/1976 | Jackson et al. . | |
| 4,574,944 | 3/1986 | Gregory | 206/5.1 |
| 4,865,186 | 9/1989 | Gates | 206/6 |
| 4,930,740 | 6/1990 | Vogt . | |
| 5,016,749 | 5/1991 | Kaye et al. . | |
| 5,423,419 | 6/1995 | Wentz et al. | 206/6 |
| 5,427,233 | 6/1995 | Zinck et al. | 206/37 |
| 5,671,503 | 9/1997 | Uebelacker et al. | 16/110.5 |
| 5,878,873 | 3/1999 | Clark | 206/6 |

*Primary Examiner*—Paul T. Sewell
*Assistant Examiner*—Luan K. Bui
*Attorney, Agent, or Firm*—Jacobson, Price, Holman & Stern, PLLC

[57] ABSTRACT

The container includes a base portion and a removable lid portion. The base and lid portions, interfit with each other to form a waterproof seal. The portions are easily separable for quick access to the interior of the container. The eyeglasses, sunglasses, contact lenses and various contact lens and eye wear lens solutions are housed in the base portion. The lid portion includes lens cleaning tissues and a mirror. In addition, a handle secured to the base portion is hollow and separable into two pieces to reveal an adjustable string or strap to facilitate the carrying of the container. The strap is placed over the shoulder or around the waist of an individual for carrying the container with the individual. The strap is adjustable so as to lengthen or shorten its length, dependent upon its use.

11 Claims, 4 Drawing Sheets

PERSONAL OPTICAL CARE CONTAINER

FIELD OF THE INVENTION

The present invention relates to an optical care container for holding various eye care products including eyeglasses, sunglasses and container lenses and eye wear lens care products.

BACKGROUND OF THE INVENTION

In today's increasingly active world, people are continuously on the go, moving from work to leisure time activities and between different leisure time activities. People oftentimes engage in one activity, then drive to another location for involvement in another activity. Extended periods of time are thereby spent away from the home. It is often required to change from use of eyeglasses to prescription or non-prescription sunglasses, and to use contact lenses during other activities.

Previously, there has been no provision for the changing of optical needs of an individual moving between different events or places over a relatively short period of time. Accordingly, there is a need to have eyeglasses, sunglasses and contact lens and eye wear lens care products readily available to an individual. Means are needed to facilitate the wearing and rapid change between different types of eye wear while an individual is on the go.

SUMMARY OF THE INVENTION

To meet the needs of an active individual, the present invention includes a personal optical care container. The container includes dividers and separators to house eyeglasses, sunglasses, sports sunglasses, a contact lens case, contact lens cleaner, various contact lens solutions, liquid lens polish, lens cleaning tissues and a mirror to assist in insertion and removal of contact lenses.

The container is used to contain eye wear products and to travel with an individual. The container is water proof so that is may be used in active, outdoor activities, including all water sports and beach activities. Also, the container is styled to fit in with all attire at any social or leisure activity.

The container includes a base portion and a removable lid portion. The base and lid portions, interfit with each other to form a waterproof seal. The portions are easily separable for quick access to the interior of the container.

The eyeglasses, sunglasses, contact lenses and various contact lens and eye wear lens solutions are housed in the base portion. The lid portion includes lens cleaning tissues and a mirror.

In addition, a handle secured to the base portion is hollow and separable into two pieces to reveal an adjustable string or strap to facilitate the carrying of the container. The strap is placed over the shoulder or around the waist of an individual for carrying the container with the individual. The strap is adjustable so as to lengthen or shorten its length, dependent upon its use.

Accordingly, it is an object of the present invention to provide a personal optical care container formed of a base portion and a lid portion which interfit so as to be locked together and form a water tight seal.

It is another object of the present invention to provide a personal optical care container having a base portion and a lid portion with the base portion having designated spaces for housing two pairs of eyeglasses and a pair of sport sunglasses of a curved configuration, with an area for receipt of a contact lens case as well as providing space for housing various contact lens and eye wear lens solutions.

It is still yet another object of the present invention to provide a personal optical care container having a base portion and a lid portion interengagable to provide a water proof seal and having a handle located on the base portion which is separable to release a carrying strap from within the handle.

It is still yet another object of the present invention to provide a personal optical care container having a base portion and a lid portion for housing various eyeglasses, sunglasses and contact lenses along with solutions for the care of the various eyeglasses and contact lenses housed in the base portion and the lid portion containing eye wear lens cleaning tissues and a mirror to assist in the insertion and removal of contact lenses.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
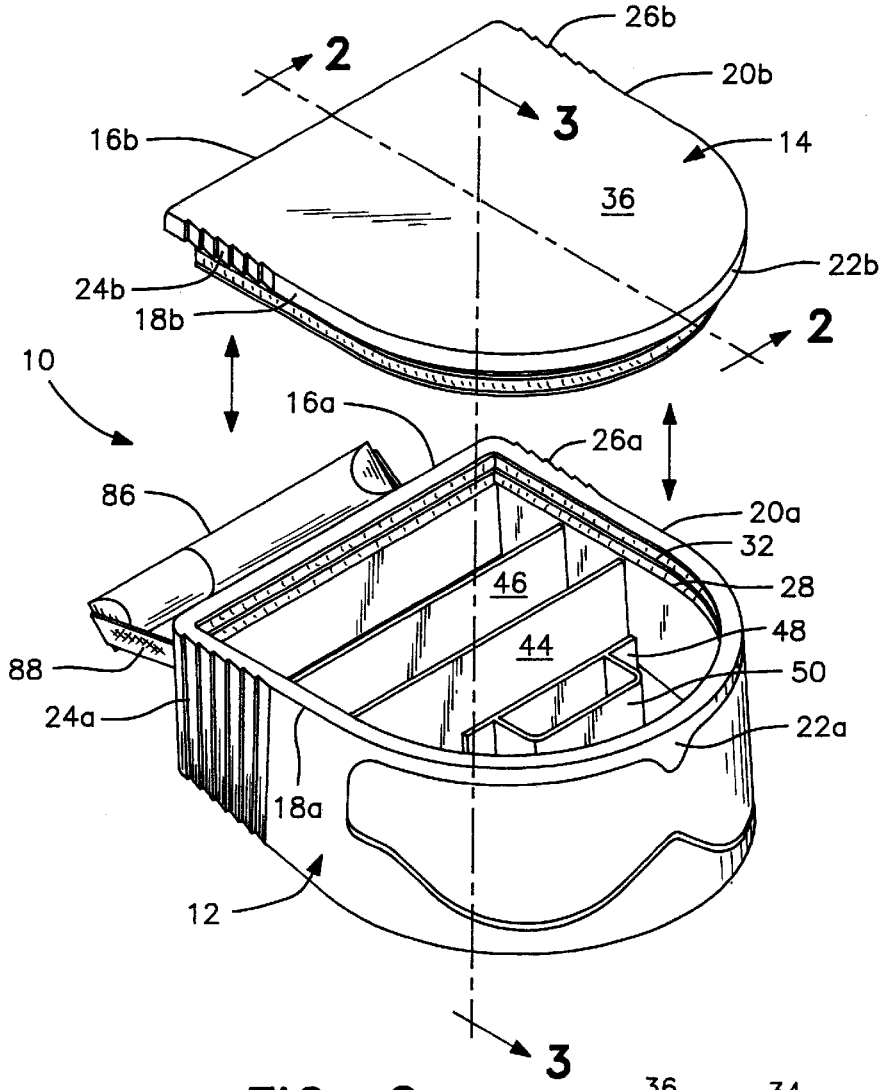
FIG. 1 is an exploded view of a base portion and a lid portion of the personal optical care container of the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1 through 5, in particular, a personal optical care container embodying the teachings of the subject invention is generally designated at 10. With reference to its orientation in FIG. 1, the personal optical care container includes a base portion 12 and a lid portion 14.

Both the base portion and lid portion include a straight rear edge 16*a,* 16*b,* respectively, located in between straight sidewalls 18*a,* 18*b,* 20*a,* 20*b,* respectively. A front edge 22*a,* 22*b,* of the base portion and lid portion, respectively, are curved in the shape of a semi-circle so as to accommodate storage of sports sunglasses which usually include a curvature of its lenses between the anchoring points of the temples.

Located in the sidewalls 18*a,* 20*a,* and 18*b,* 20*b* are a plurality of gripping ridges 24*a,* 26*a* and 24*b* and 26*b*. In the assembled condition of the base portion and lid portion, the gripping ridges facilitate the holding of the container 10.

The waterproof interlocking of the base portion and the lid portion is facilitated by the base portion including a semi-circular bead projection 28 extending about the entire inner periphery 30 of the base portion 12. Located above the projection 28 is a semi-circular recessed groove 32 extending about the entire periphery of the interior 30 of the base portion 12.

In the lid portion, located in an undercut portion 34 which extends around the periphery of the top plate 36 of the lid portion, is, in descending order, a semi-circular shaped projection 38 located above a semi-circular shaped groove 40. Due to the resilient plastic composition of the lid portion 14, when the lid portion 14 is placed on top of the base portion 12 and downward force is applied to the lid portion, edge portion 42 would initially be deflected inwardly as it engages and passes over projection 28 in the base portion. Simultaneously with the projection 28 fitting into the groove 40, the projection 38 of the lid portion 14 fits into the groove 32 of the base portion upon outward deflection of the edge 42 of the base portion. In assembled form, the lid portion 14 and the base portion 12 form a waterproof seal.

In the base portion, a plurality of partitions 44, 46, extend across the entire width of the base portion. In addition, a partial partition 48 forms the rear wall of a four sided container completed by U-shaped wall 50.

Figure 5:
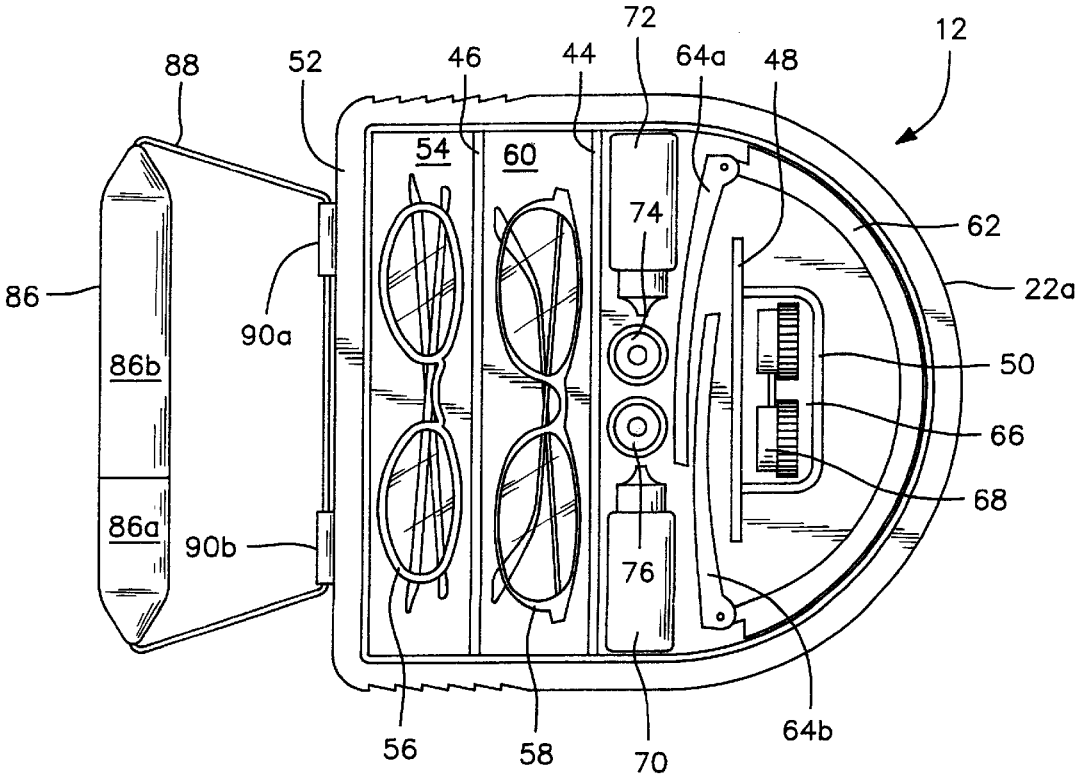
FIG. 5 is a top plan view of the interior of the base portion of the personal optical case container of the present invention illustrating various stored eyeglasses, sunglasses, contact lenses and eye wear solutions.

As shown in FIG. 5, the space between partition 46 and rear wall 52 of the base portion 12, forms a storage compartment 54 for receipt of a pair of sunglasses 56. Similarly, between partition walls 44 and 46 is formed a storage compartment for storing a pair of eyeglasses 58 in compartment 60.

Housed in a front section of the base portion 12 is a pair of sports sunglasses 62 having a curvature which is accommodated by the curvature of front wall 22*a* of the base portion 12. The temples 64*a,* 64*b* of the sunglasses 62 are folded inwardly to lie behind the partial partition wall 48.

In the enclosed area 66, formed between the partition 48 and U-shaped wall 50, is housed a contact lens case 68. In addition, located between the partition wall 48 and partition wall 44 is space to accommodate various solution bottles such as, for example, lens polish bottle 70, lens cleaner bottle 72, contact lens cleaner bottle 74 and contact lens lubricating solution 76.

The lens solution bottles and the particular choice of eyeglasses and sunglasses shown are examples of the types and number of pairs of glasses and solutions which may be contained in the base portion 12 of the personal optical care container of the present invention. It is understood that other arrangements of glasses may be used as well as alternative stored articles included. For example, personal identification information, may also be included in the base portion along with money, credit cards and/or other personal items.

Figure 4:
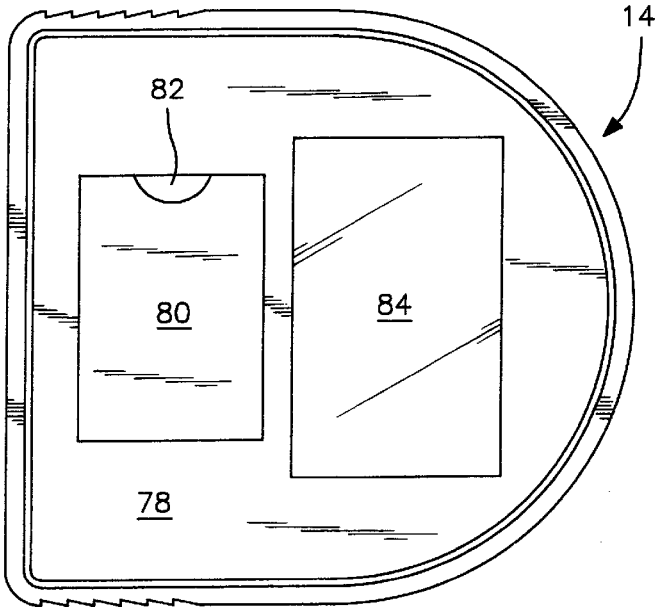
FIG. 4 is a top plan view of the interior surface of the lid portion of the personal optical care container of the present invention.

As shown in FIG. 4, on the underside 78 of the lid portion 14 may be a storage package 80 for holding lens cleaning tissues 82, for example. Also, a mirror 84 may be included on the underside 78 of the lid portion 14.

Figure 2:
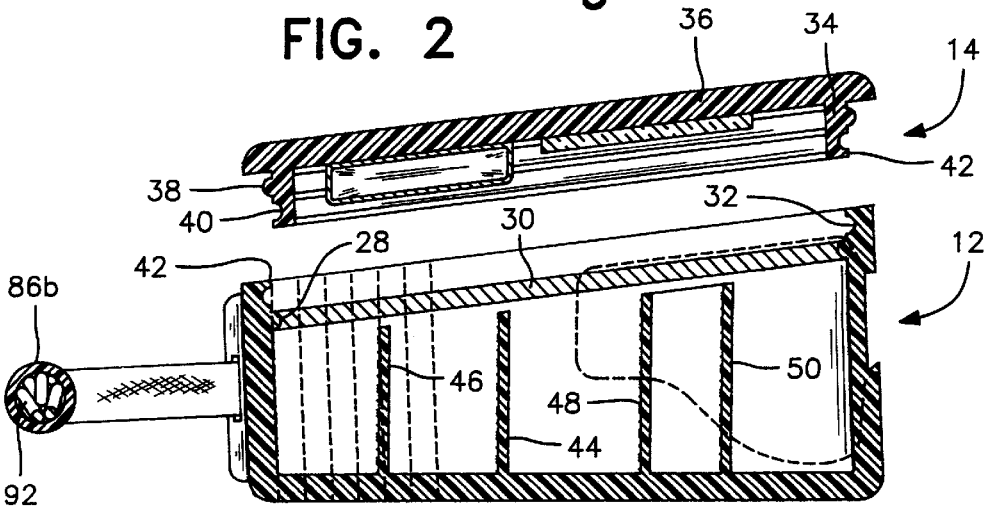
FIG. 2 is a cross-sectional view taken along line 2—2 of FIG. 1.
Figure 3:
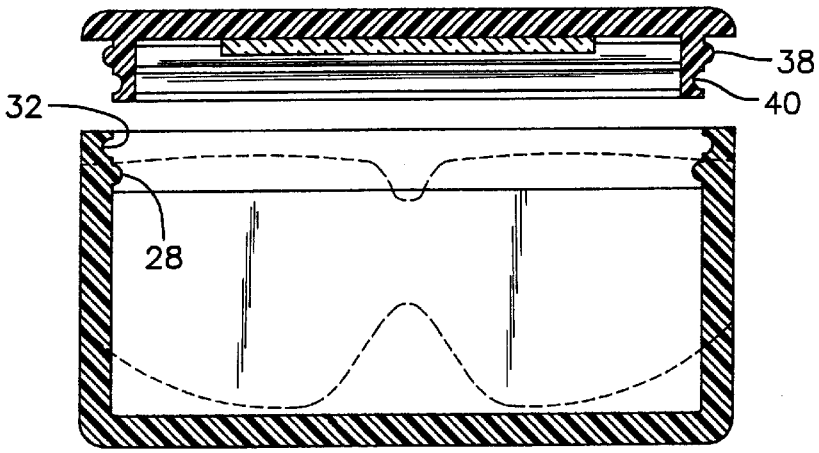
FIG. 3 is a sectional view taken along line 3—3 of FIG. 1.
Figure 6:
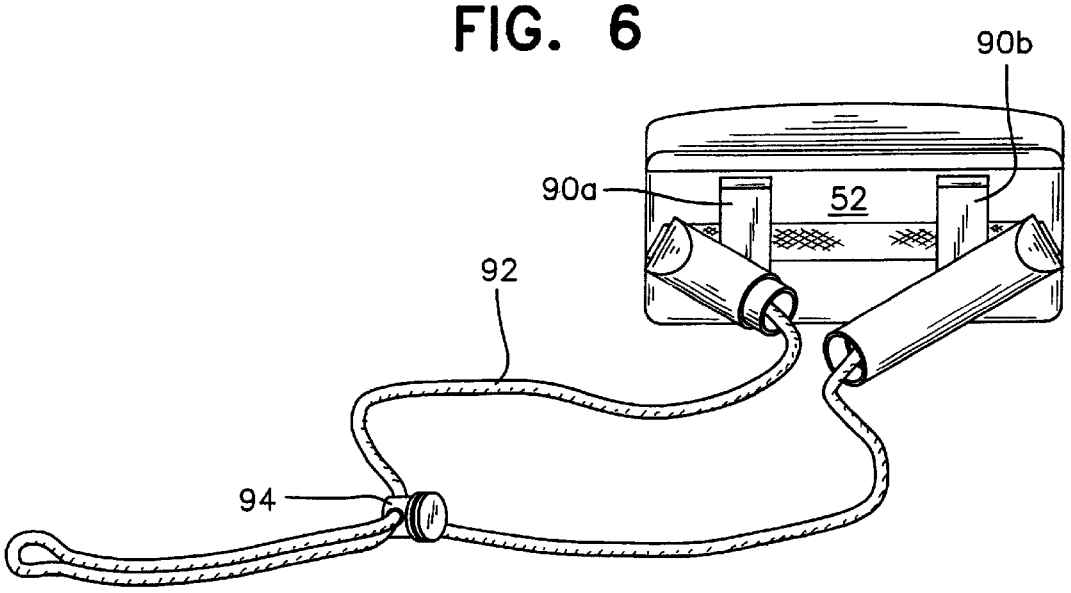
FIG. 6 illustrates the handle of the base portion being separated to reveal a carrying strap having an adjustable stop mechanism.

As shown in FIGS. 1 and 5, the base portion 12 includes a handle 86 anchored by a strap 88 to two anchors 90*a,* 90*b* through which the strap 88 is threaded. The handle 86 is divided into two sections 86*a* and 86*b* as shown in FIG. 2. Housed within the hollow material of the handle 86 is a string or strap 92. As shown in FIG. 6, the string or strap 92 is of an extended length and includes a sliding lock mechanism 94 located on the string 92.

The lock mechanism 94 is slidable along the length of the string 92 to lengthen or shorten the string. The personal optical care container of the present invention may be worn around the shoulder 96 of an individual 98 with the lock mechanism 94 located adjacent to a folded central portion of the string 92. Alternatively, the string 92 may have the locking mechanism 94 moved along its length so as to shorten the opening formed by the string and the rear 52 of the container 10 so as to fit about the waist 100 of an individual 98.

Figure 7:
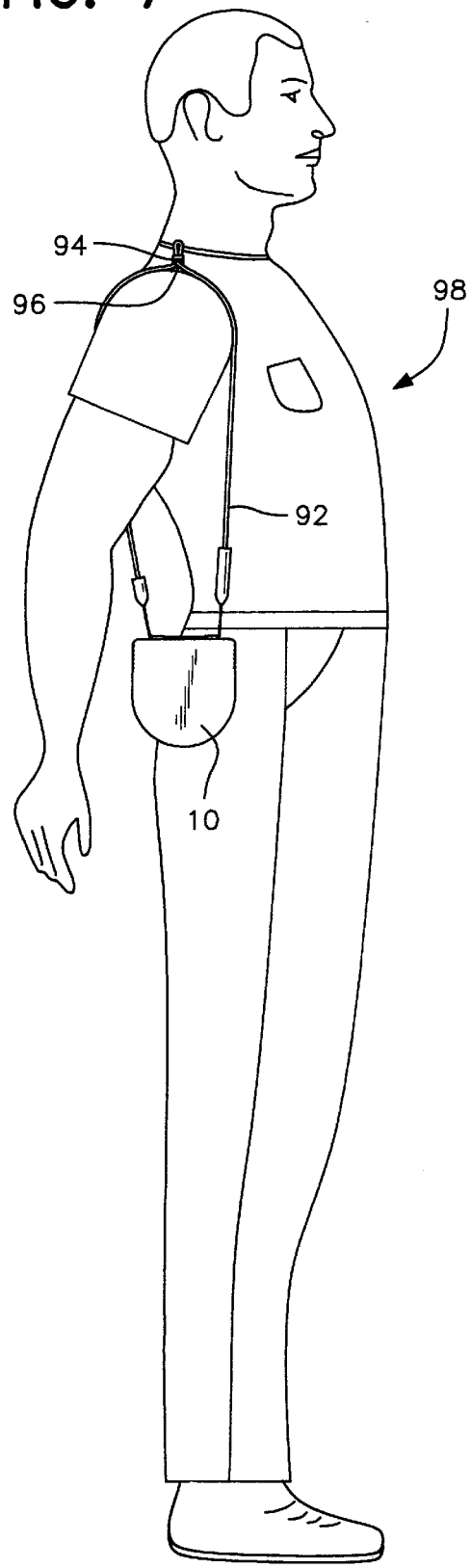
FIG. 7 illustrates the use of the personal optical care container of the present invention with its strap used as a shoulder strap.
Figure 8:
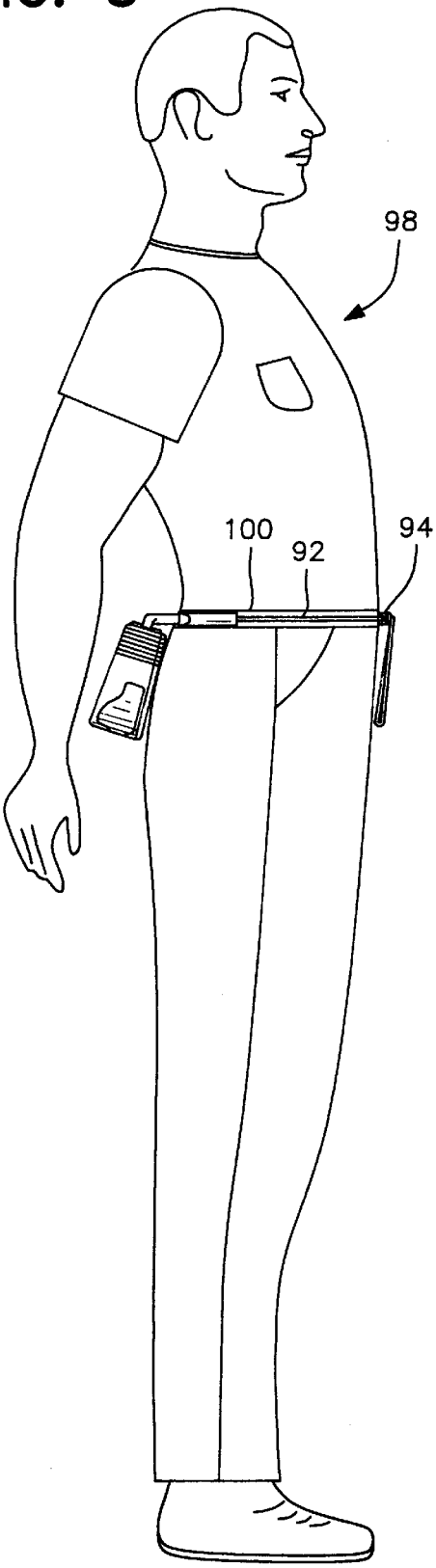
FIG. 8 illustrates the use of the personal optical care container of the present invention with its strap used as a waist strap.

The personal optical care container of the present invention may then be carried casually as shown in FIG. 7 or carried cinched about the waist as is required during more active sports participation. Alternatively, the locking mechanism 94 may be slid further towards the container 10 such as to secure the container around the hand of an individual to accommodate other activities.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. In combination, an optical care container and a pair of curved sports glasses, said combination comprising:

a base portion, said base portion including a flat bottom interconnected with a straight rear wall, two straight side walls extending from said straight rear wall and a continuous curved front wall interconnecting said two straight side walls for storage of continuously curved sports glasses, and a lid portion interengagable with said base portion, said base portion containing at least one partition separating said base portion into compartments for containing at least two pairs of eye wear including said pair of curved sports glasses being located next to said curved front wall and a compartment for containing a contact lens case.

2. An optical care container as claimed in claim 1, wherein said lid portion snap fits into said base portion.

3. An optical care container as claimed in claim 2, wherein said lid portion includes a projection for fitting into a recess of said base portion and a recess for receiving a projection of said base portion.

4. An optical care container as claimed in claim 1, wherein said lid includes a mirror.

5. An optical care container as claimed in claim 1, wherein said base portion and said lid portion includes a plurality of gripping ridges.

6. In combination, a personal optical care container and a pair of curved sports glasses, said combination comprising:

a base portion, said base portion including at least one partition separating said base portion into compartments for containing eye wear products and said base portion including a flat bottom interconnected with a straight rear wall, two straight side walls extending from said straight rear wall and a continuous curved front wall interconnecting said two straight side walls and storing said curved sports glasses next to said curved front wall, said base portion also including a compartment for containing a contact lens case, and a lid portion having a same exterior shape as said base portion, said lid portion being removably engaged with said base portion to form a waterproof seal.

7. A personal optical care container as claimed in claim 6, wherein said lid portion includes a projection for fitting into a recess of said base portion and a recess for receiving a projection of said base portion.

8. An optical care container comprising:

a base portion, and a lid portion interengagable with said base portion, said base portion containing compartments for containing at least two pairs of eye wear and a compartment for containing a contact lens case, said base portion including a handle, said handle being hollow said separable into two portions and a strap being housed in said handle.

9. An optical care container as claimed in claim 8, wherein said strap includes a slidable lock mechanism for adjusting a length of said strap.

10. A personal optical care container comprising:

a base portion, said base portion including compartments for containing eye wear products, and a lid portion having a same exterior shape as said shape portion, said lid portion being removably engaged with said base portion to form a waterproof seal, said base portion including a handle, said handle being hollow and separable into two portions and a strap being housed in said handle.

11. A personal optical care container as claimed in claim 10, wherein said strap includes a slidable lock mechanism for adjusting a length of said strap.

* * * * *